United States Patent [19]

Mandel et al.

[11] 4,400,786

[45] Aug. 23, 1983

[54] ELEVATOR SYSTEM WITH SPEECH SYNTHESIZER FOR AUDIBLE INFORMATION

[75] Inventors: Alan F. Mandel, Scott Township, Allegheny County; Kenneth M. Eichler, North Versailles; Douglas A. Bauman, Franklin Township, Westmoreland County, all of Pa.

[73] Assignee: Westinghouse Electric Corp., Pittsburgh, Pa.

[21] Appl. No.: 215,893

[22] Filed: Dec. 12, 1980

[51] Int. Cl.[3] ..... B66B 3/00; G10L 1/08

[52] U.S. Cl. ..... 364/513; 340/19 A; 340/692; 364/424

[58] Field of Search ..... 364/400, 424; 340/19 A, 340/692

[56] References Cited

U.S. PATENT DOCUMENTS

| | | | |
|---|---|---|---|
| 2,991,448 | 7/1961 | Diamond et al. | 340/19 A |
| 3,375,491 | 3/1968 | Hornung et al. | 340/19 A |
| 4,301,328 | 11/1981 | Dorais | 179/1 SM X |
| 4,310,825 | 1/1982 | Tsunoda et al. | 179/1 SM X |
| 4,335,379 | 6/1982 | Martin | 179/1 SM X |

FOREIGN PATENT DOCUMENTS 54-97950 8/1979 Japan ..... 340/19 A

OTHER PUBLICATIONS

Master Specialities Company: Automatic Number Announcer, Catalog No. 3041, Jul. 1973.

Master Specialities Company: Expandable Voice Annunciator F 1047, Oct. 1974.

Hodges et al: The Implementation of an all Digital Speech Synthesizer, Conference Proceedings IEEE Int. Conference on Acoustics, Speech and Signal Processing, Denver Co. Apr. 1980, pp. 855-858.

*Primary Examiner*—Felix D. Gruber

*Attorney, Agent, or Firm*—D. R. Lackey

[57] ABSTRACT

An elevator system having a plurality of elevator cars, and communication apparatus which includes a speech synthesizer for each car which provides audible, informative messages in its associted elevator car in response to its operation. Different messages may be simultaneously reproduced in the different elevator cars from a single vocabulary which is common to all messages and all elevator cars. A single central processing unit periodically replenishes the memory of each car's speech synthesizer before interruption can occur in the message due to lack of vocabulary information.

10 Claims, 8 Drawing Figures

ELEVATOR SYSTEM WITH SPEECH SYNTHESIZER FOR AUDIBLE INFORMATION

BACKGROUND OF THE INVENTION

1. Field of the Invention:

The invention relates in general to elevator systems, and more specifically to elevator systems which include means for providing audible messages in a plurality of elevator cars.

2. Description of the Prior Art:

In the past, audible, informative messages have been produced in elevator cars, with the messages being prerecorded on tape, or other suitable recording means. Recently, several different techniques have been developed for synthesizing human speech electronically, and speech synthesizer processor units are now available and are being applied to many different applications. In the elevator application, the greatest need for audible in-car messages is in a bank of elevators, i.e., installations having a plurality of elevator cars controlled by a central supervisory processor. While large scale integrated circuits have lowered the cost of such speech synthesizer systems, the overall cost in providing such systems for a bank of elevator cars is still appreciable, because of the plurality of cars involved.

SUMMARY OF THE INVENTION

Briefly, the present invention is a new and improved elevator system having two or more elevator cars, which includes digitized human speech synthesis in all of the cars. The system cost of the verbal communication portion of the apparatus is substantially reduced by the present invention wherein only a single central processing unit (CPU), a single vocabulary source, and a single message instruction source, are required. The only percar apparatus required for the communication system is the speech synthesizer unit, external analog filtering and amplification, and the speaker. Notwithstanding the fact that the message center, vocabulary source, and CPU are common to all of the cars of the bank of cars, audible messages may be simultaneously provided in all of the cars by an "interleaving" arrangement which permits different, or like, audible, informative messages to be produced without interruption. Each speech synthesizer unit includes a memory, with the digital information stored therein being used by the speech synthesizer chip on a first in-first out (FIFO) basis. The CPU "fills" this FIFO memory with vocabulary information associated with the specific messages to be delivered, at the start of the message for an elevator car, and then it goes about tending to the message needs of the other elevator cars, filling their FIFO memories in like manner when their systems initiate a verbal message. The CPU continually checks the level of the FIFO memories, replenishing each FIFO memory with a predetermined number of bytes of the next sequential vocabulary information required by the specific message, from the vocabulary source, before each FIFO memory has been emptied.

BRIEF DESCRIPTION OF THE DRAWINGS

The invention may be better understood, and further advantages and uses thereof more readily apparent, when considered in view of the following detail description of exemplary embodiments, taken with the accompanying drawings in which.

DESCRIPTION OF PREFERRED EMBODIMENTS

Figure 1:
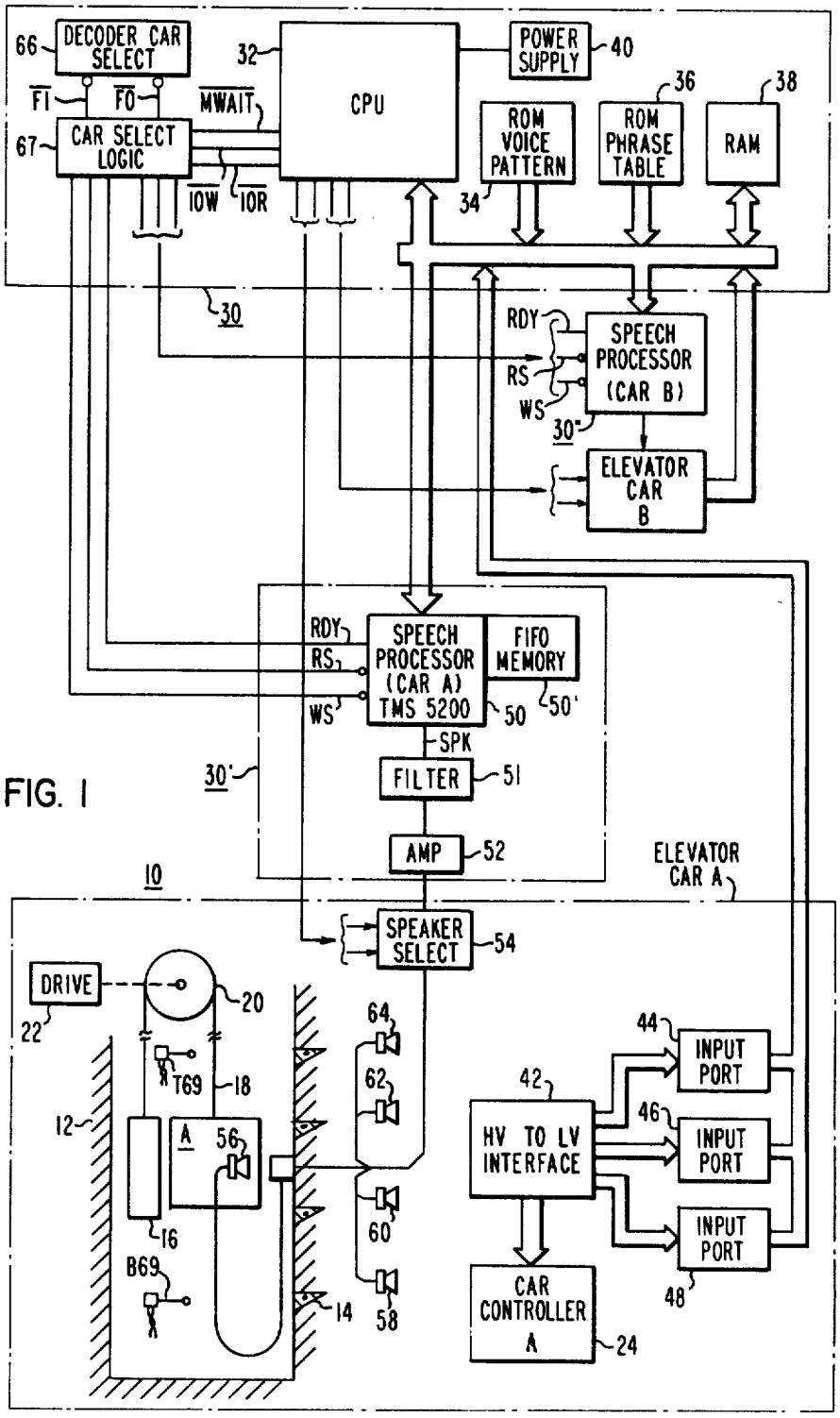
FIG. 1 is a partially schematic and partially block diagram of an elevator system constructed according to the teachings of the invention.

Referring now to the drawings, and to FIG. 1 in particular, there is shown an elevator system 10 constructed according to the teachings of the invention. Elevator system 10 includes at least two elevator cars, referenced car A and car B, with each being mounted for movement in hatchways of a building 12 having a plurality of floors, shown generally at 14. The elevator cars may be driven by the traction system illustrated, or by any other suitable drive arrangement, such as hydraulic. In the traction arrangement, car A is connected to a counterweight 16 via a plurality of wire ropes 18 which are reeved about a drive sheave 20. Drive sheave 20 is driven by a drive machine 22, which may include a DC motor and a suitable DC power supply, or an AC motor and a suitably controlled AC supply voltage.

Each elevator car has like car controls, such as a car controller 24 for car A, which includes a floor selector and a speed pattern generator. In order to prevent each elevator car from responding to a hall call, they may in turn be controlled by supervisory control which causes the elevator cars to handle hall calls in an efficient manner, according to a predetermined strategy. The specific details of the elevator car controllers and the supervisory control are not important to the present invention, and thus they are not shown in order to limit the length and complexity of the application. For example, suitable car controllers are set forth in U.S. Pat. Nos. 3,750,850, and 3,902,572, and suitable supervisory controllers are set forth in U.S. Pat. Nos. 3,851,733, 4,007,812 and 4,037,688, all of which are assigned to the assignee of the present invention. For purposes of the present invention, it is only necessary that the various car controllers prepare predetermined status signals responsive to the operation of their associated elevator cars, which status signals, when true, each indicate to a speech synthesizer system which includes a supervisory unit 30 common to all cars, and per car speech processor units, such as units 30' and 30'' for cars A and B, respectively, that a specific verbal message should be prepared and audibly reproduced. The status signals, for most elevator related messages, are already available in the car controllers and/or supervisory control of an elevator system, while others may be produced by simple logic in response to the already available operational signals produced during the normal operation and control of the elevator system. Examples of status signals which are already available, or reproducible from already available signals, are set forth in Table I. Suitable associated messages which may be produced in response thereto, are also set forth in Table I. The elevator signals used for purposes of example may be found in the systems of U.S. Pat. Nos. 3,902,572 and 4,007,812. The former U.S. Patent sets forth car controls, and the latter U.S. Patent sets forth supervisory control for a plurality of cars. The elevator signals used in Table I are listed in Table II, along with their function.

TABLE I

| Status Signal Issued In Response To Elevator Signals | Message |
|---|---|
| 81U · 80C · $\overline{45R}$ | Going up |
| 81D · 80C · $\overline{45R}$ | Going down |
| NEXT | This car is next up |
| $\overline{NEXT}$ · car call button is pressed | This car is not next |
| 34R · 23R | This car is stopping at floor _ |
| LW | This car is fully loaded |
| $\overline{70T}$ · $\overline{45R}$ | The doors are going to close |

TABLE II

| Elevator Signal | Function |
|---|---|
| 23R | The car is running |
| 34R | The car is going to stop |
| $\overline{45R}$ | The doors are fully open |
| $\overline{70T}$ | Door non-interference time has expired |
| 80C | The car is going to make a run |
| 81U | The car is going to travel up |
| 81D | The car is going to travel down |
| NEXT | This car is the next to leave main floor |
| $\overline{NEXT}$ | Car is at main floor but it is not next |
| LW | The car is fully loaded |

The floor position of a stopped elevator car, and the floor at which a moving elevator is going to stop, may be communicated to the speech synthesizer unit 30 from the car controllers as a digital count, or, as will be hereinafter described, the speech synthesizer unit 30 may maintain its own floor position counter in memory using elevator signals B69, T69, N, 81U and 81D. Signals B69 and T69 are true when the elevator car is at the bottom and top floors, respectively, and these signals may be used to reset the floor position count. Signal N changes logic state each time the selector notches into another floor, with this signal being used to advance, or decrement, the floor position counter according to travel direction, as indicated by signals 81U and 81D.

More specifically, the speech processor unit 30 includes a single central processor unit (CPU) 32, a single source 34 of vocabulary information, which is stored in a read-only-memory (ROM), a single source 36 of message instructions for all messages, also referred to as a phrase table, which is also stored in ROM, a random access memory (RAM) 38, and a power supply 40. The speech processor unit 30 is common to all of the elevator cars, and may be INTEL's SBC80/24 microprocessor board, for example, in which the CPU is the 8085. Additional ROM, as required for storing the speech patterns for the predetermined vocabulary, may be added to the basic 80/24 board via an SBC multi-bus.

The per-car equipment includes a high voltage-to low voltage interface, such as interface 42 for car A, and a plurality of input ports, such as input ports 44, 46 and 48 for car A. The interface 42 is a 24 channel, optically isolated 125 volt D.C. to 5 volt D.C. interface. Thus, up to 24 car status signals at the 125 volt D.C. level may be provided by each car controller, such as car controller 42, which signals are changed to the 5 volt logic level by interface 42 and applied to input ports 44, 46 and 48, with each input port receiving eight of the status signals. The input ports may be INTEL's 8212. As shown in FIG. 1B, which is an enlarged fragmentary view of the output of car controller 24, the first five status signals may be the signals CPU 32 requires to keep track of each car's floor position, while the remaining status signals may be message selection signals numbered in ascending order starting from the left.

Additional per-car equipment includes a speech processor unit for each car, such as speech processor unit 30' for car A. For purposes of example, it will be assumed that speech processor unit 30' includes a processor 50, such as T.I.'s TMS5200, which includes a FIFO RAM 50' having a capacity of 16 bytes. The per-car equipment is completed by an analog filter and power amplifier, shown generally at 51 and 52, respectively, for car A, a speaker select function, if desired, illustrated at 54 for car A, and audio speakers. The audio speakers include at least one speaker in each elevator car, such as speaker 56 in car A. If desired, a speaker may also be disposed at each floor, close to the hatch door opening for each car, such as behind, or in place of, the hall lantern or car position indicator. For example, floor speakers 58, 60, 62 and 64 are shown associated with car A. If no speakers are desired at the floors, the speaker select function 54 would not be required.

Each speech processor 50 includes read and write inputs RS and WS, respectively, an output RDY which goes low when the speech processor is ready to receive information during a "write" operation, or when it is ready to provide an output during a "read" operation, and an output SPK which is the audio information in analog form ready for filtering, amplification and reproduction.

As will be hereinafter explained, CPU 32 writes vocabulary information into the FIFO memory 50' of each speech processor 50, selecting the desired speech processor by applying a low signal to its write input WS. The speech processor 50 can only receive information at a predetermined rate, and the speech processor signals when it is ready to receive information by causing its RDY output to go low. The speech processor 50 also sets certain internal bits which may be read by CPU 32. For example, when its FIFO memory is less than one-half full, it sets a bit to signify this fact. Also, an internal code in the vocabulary information indicates to the speech processor when the phrase it is speaking has been completed, and the speech processor sets an internal bit to indicate that it has "finished talking".

CPU 32 selects the desired car via a decoder 66, such as TI's 74LS42. CPU 32 outputs 0000 when it selects car A, and 0001 when it selects car B, with output $\overline{F0}$ of decoder 66 going low to select car A, and an output $\overline{F1}$ goes low to select car B.

Figure 1A:
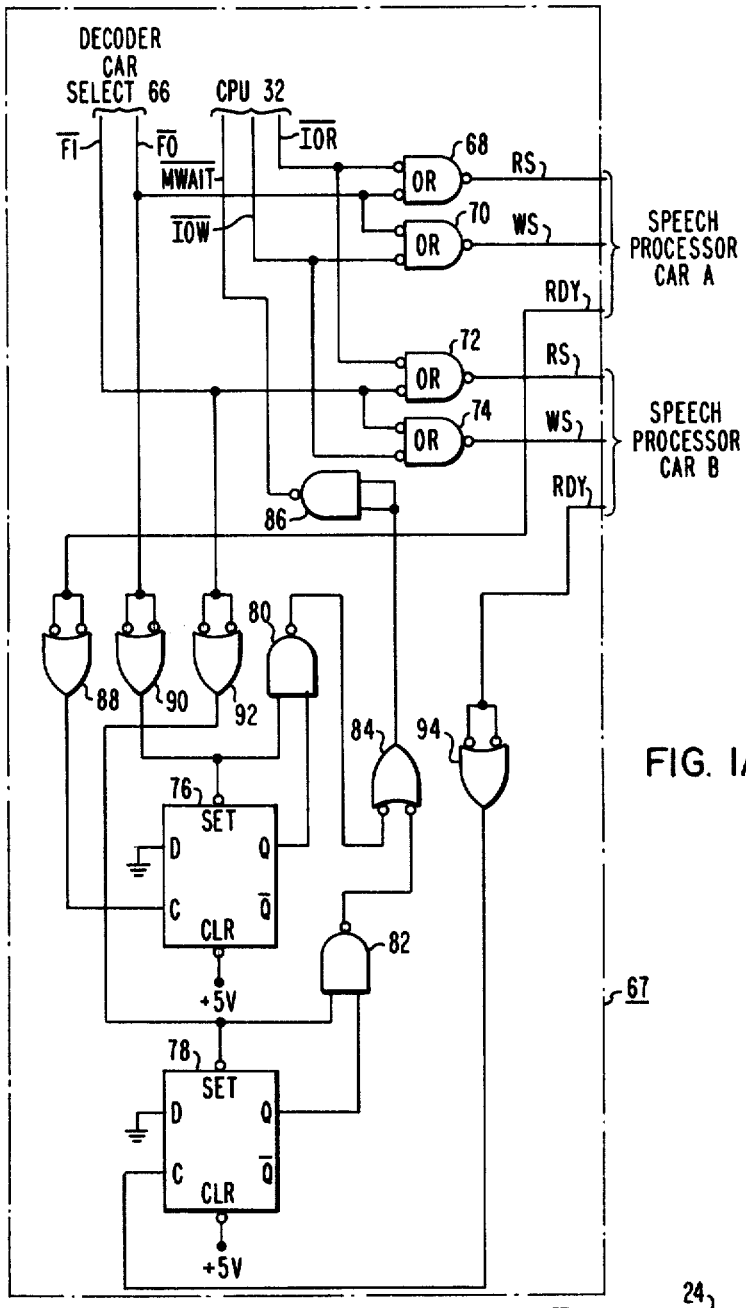
FIG. 1A is a schematic diagram of car select logic which may be used for this function shown in block form in FIG. 1.
Figure 1B:
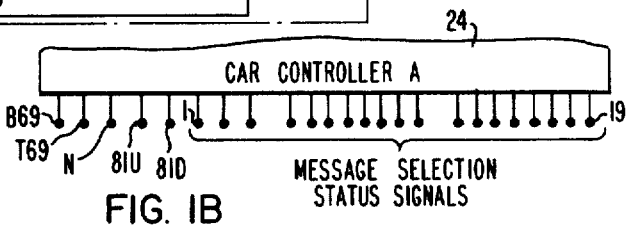
FIG. 1B is an enlarged portion of FIG. 1, illustrating a typical status signal output of an elevator car to the speech processor unit.

Read and write commands $\overline{IOR}$ and $\overline{IOW}$, respectively, are communicated from CPU 32 to a selected speech processor 50 via a logic circuit 67 shown in detail in FIG. 1A. Logic circuit 67 includes a plurality of OR gates 68, 70, 72 and 74. When CPU 32 desires to read speech processor 50, its output $\overline{IOR}$ goes low and signal $\overline{F0}$ goes low, causing OR gate 68 to output a low signal which is the true input required by the read input RS of speech processor 50. The condition of the settable bits in speech processor 50 are then conveyed to the CPU via the data bus.

When CPU 32 desires to write information into speech processor 50, its output $\overline{IOW}$ goes low and signal $\overline{F0}$ goes low, causing OR gate 70 to provide a low true output to input WS of speech processor 50. When speech processor 50 is ready to receive the data, its output RDY goes low. Its RDY output, as well as the RDY output of the speech processor for car B, are applied to the logic circuit 67, which also includes first and second D-type flip-flops 76 and 78, such as T.I.'s 74LS74, and NAND gates 80, 82, 84, 86, 90, 92 and 94, such as T.I.'s 74LS00. If speech processor 50 for car A is selected, for example, and output RDY of speech processor 50 is high, flip-flop 76, which was set before signal $\overline{F0}$ went low, remains set. NAND gate 80 thus has two high inputs and it applies a low input to NAND gate 84, forcing its output high and the output of NAND gate 86 low. The low output from NAND gate 86 is applied to the $\overline{MWAIT}$ input of CPU 32, which causes CPU 32 to wait before writing or reading information relative to this speech processor. When speech processor 50 is ready for the read or write opeation, its output RDY goes low, clocking flip-flop 76 to provide a low Q output. The output of NAND gate 80 goes high, and since car A has been selected, not car B, signal $\overline{F1}$ is high applying a low input to NAND gate 82 via NAND gate 92. Thus, NAND gate 84 has two high inputs and its resulting low output is inverted by NAND gate 86 to provide a high signal at input $\overline{MWAIT}$, notifying CPU 32 that speech processor 50 is ready for the requested operation.

Figure 2:
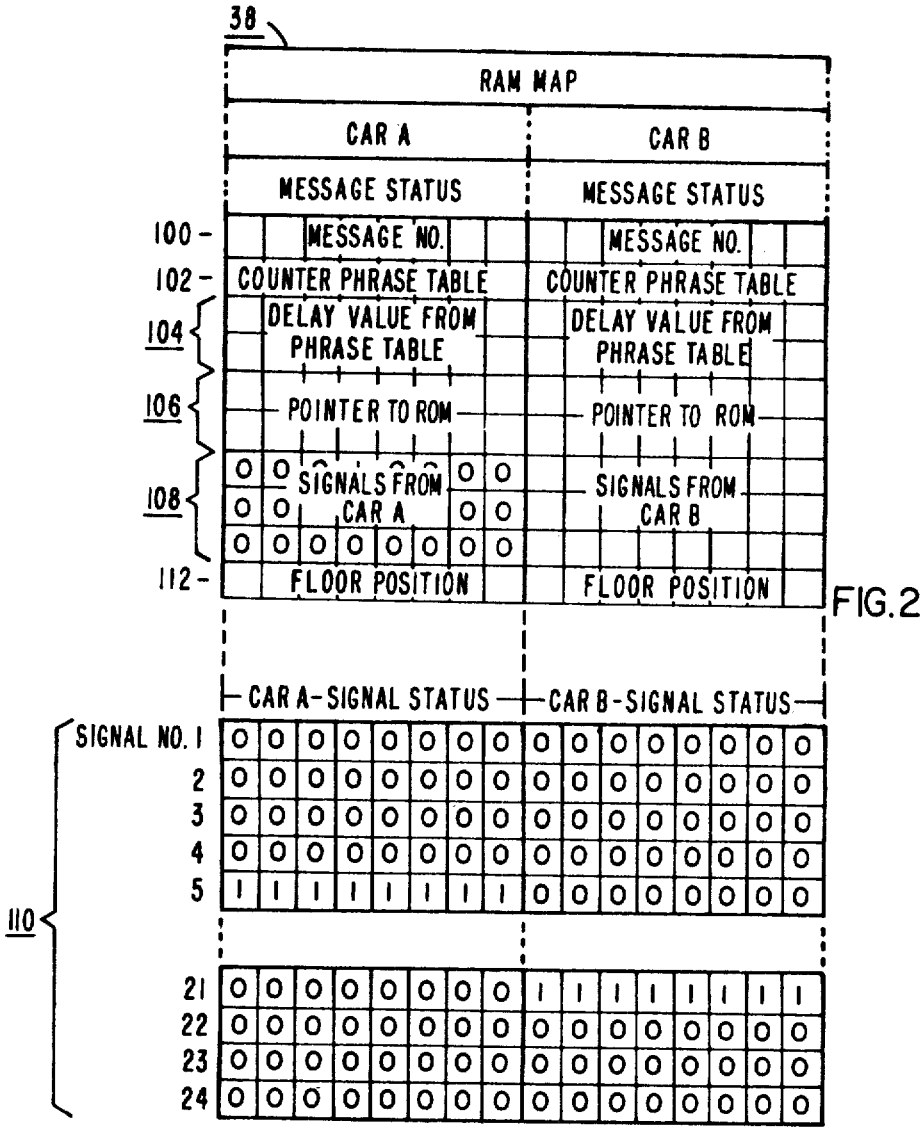
FIG. 2 is a RAM map setting forth certain memory locations and their contents used by the elevator system shown in FIG. 1.

FIG. 2 is a RAM map illustrating the various items of information stored by CPU 32 in RAM 38 as it goes about the task of providing verbal messages in elevator cars A and B, as well as any additional cars in the bank of elevator cars. The number of elevator cars which may be handled by a single CPU is determined by the speed of the CPU and the running time of the program. The car limit is determined by calculating the number of cars which will cause a memory of a speech processor to run out of vocabulary information before completing a phrase, as the complete vocabulary information for the phrases usually includes more bytes of data than can be handled by the memory of the speech processor. A phrase may be a single word, or a group of words.

Figure 2A:
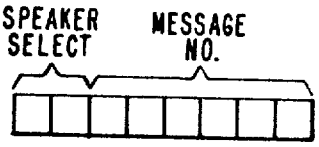
FIG. 2A illustrates a modification of the message number which may be used to additionally select the speakers to be activated for the specific message.

More specifically, CPU 32 sets up a table in RAM 38 for each elevator car. Since the table for each car is similar, only the table for car A will be described in detail. The table for car A includes a location 100 for storing the number of the message currently being processed. If no message is currently being processed for car A, location 100 will contain 0's. If message No. 19 is being processed, for example, location 100 will contain 00010011. FIG. 2A illustrates a modification which may be used when floor speakers are utilized, as well as a car speaker. Since it will be known which speaker, or speakers should be activated for each specific message, the speaker selection may be included as part of the message number. Thus, three bits of the eight-bit message number word may be used to select the speakers, and the remaining bits used to identify the message number. Table III sets forth an example of a speaker select arrangement which may be used.

TABLE III

| Speaker Select Code | Speakers Selected |
|---|---|
| 0 0 | Car only |
| 0 1 | Car plus adjacent/target floor |
| 1 0 | Car plus all landings |
| 1 1 | Only a specific landing |

Location 102 functions as a counter which points to the present location of the program as it progresses through the list of instructions for the specific message being run. These message instructions are called the phrase table, which is stored in ROM 36.

Figure 3:
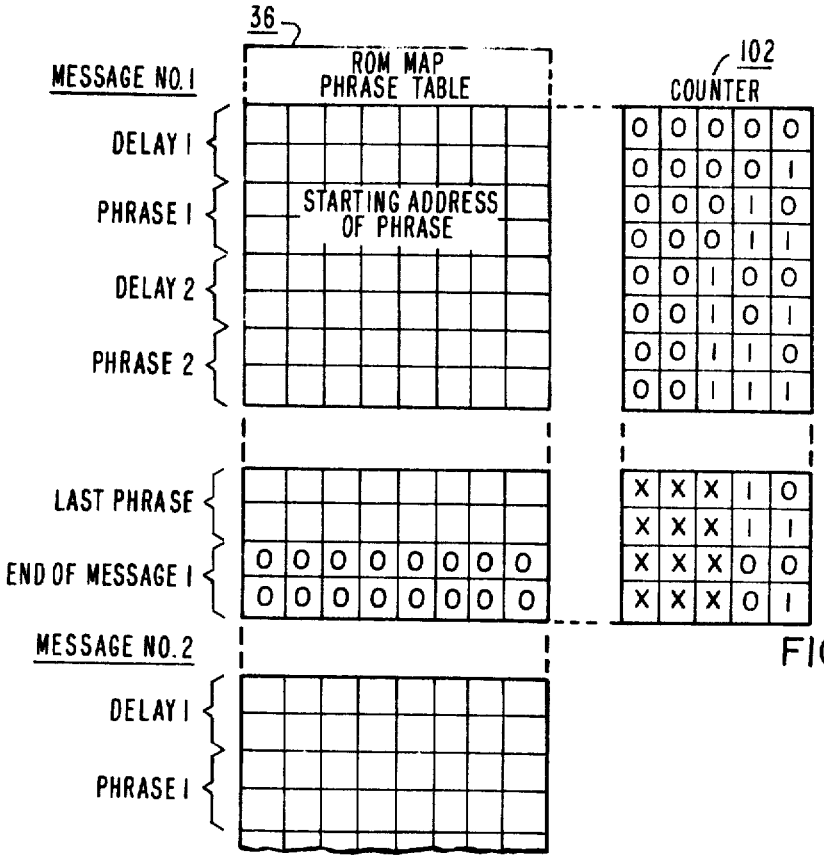
FIG. 3 is a ROM map illustrating how the instructions for each message may be stored in ROM, with the count for each byte, maintained by the counter shown in the RAM map of FIG. 2, also being shown.

FIG. 3 is a ROM map of the phrase table. The phrase table sets forth the instructions for formulating each of the messages. In an exemplary embodiment, it will be assumed that each message will be made up from a maximum of 16 phrases, with a delay before each phrase, making a total of 32 binary words. Each of the 32 binary words is formed of two eight-bit bytes, and thus there are 64 bytes in each message. The counter in location 102 of the RAM shown in FIG. 2 starts with all 0's for byte No. 1, and it is advanced on each byte. The first two bytes, as illustrated, are a delay instruction which contain a binary number signifying the length of the delay desired from the time the associated status signal goes true until the audible message begins. For example, if the status signal goes true at the start of slow-down, it may be desired to announce the floor number in the car two seconds later. The binary number which will cause the message to be delayed for two seconds will form the first two bytes of the message. This number is equal to the delay desired divided by the program cycle time. The next two bytes are an address instruction, containing the starting address in ROM 34 of the vocabulary information for the first phrase. The next two bytes define the desired delay between phrase 1 and phrase 2. The counter at location 100 of RAM 38 is incremented with each byte, and its count is reproduced alongside the bytes of message No. 1 in the phrase table of FIG. 3. In addition to the counter at memory location 102 always pointing to the exact location in the message instruction list to which the message has progressed, the bit next to the LSB always indicates whether the message is in a delay, or in a phrase. It will be noted that a zero at this bit location signifies the message is in the delay mode, and a one at this location signifies that the message is in a phrase mode.

The end of the message is signified by all 0's in the delay bytes, when the message ends before the end of the 64 bytes. If all 64 bytes are used, the end of the message is signified when the phrase counter at memory location 102 reaches 00111111, which signifies that all 64 bytes of instructions have been accessed.

Returning now to FIG. 2, each time a delay instruction is encountered in the phrase table, the value of the delay is stored at location 104 so it can be decremented on each running of the program. When it is decremented to 0, the counter at location 102 is advanced two bytes to point to the next phrase in the phrase table.

The phrases in the phrase table give the starting address in ROM for the phrase in question. This starting address is stored at location 106 in RAM, and it forms a pointer to the ROM. As each byte of vocabulary information is loaded into the FIFO memory of a speech processor, the address at location 106 is incremented. Thus, after loading 16 bytes, or 8 bytes, of vocabulary into the FIFO memory, as will be hereinafter explained, the CPU can proceed to other tasks, with location 106 containing the address in ROM of the next byte to be loaded.

Location 108 in RAM 38 stores the last readings from the input ports 44, 46 and 48, and it thus requires 24 bits or 3 bytes of memory. CPU 32 uses this location to determine when a status signal goes true by comparing each input of the reading with the stored results of the last reading. If a bit location changes from a 0 to a 1, the CPU changes this bit location of memory location 108 to a 1, and it also sets a corresponding word to 1's in a "status signal acknowledged" memory located at memory location 110. Memory location 110 includes an eight-bit word for each of the 24 inputs. If input 5, for example, changes from a 0 to a 1, bit 5 of the first byte of location 108 would be changed from a 0 to a 1, and the fifth word (byte) at location 110 would be set to FF, or all 1's.

Location 112 includes the floor position of the elevator car. If the elevator car is standing, location 112 indicates the floor number at which the car is standing. If the elevator car is moving, location 112 indicates the next floor at which the elevator car can make a normal stop according to a predetermined deceleration schedule. This location may be received from an external source, or, as hereinbefore stated, it may be determined by CPU 32 from the signals applied to the first five inputs of the 24 signal inputs.

Figure 4A:
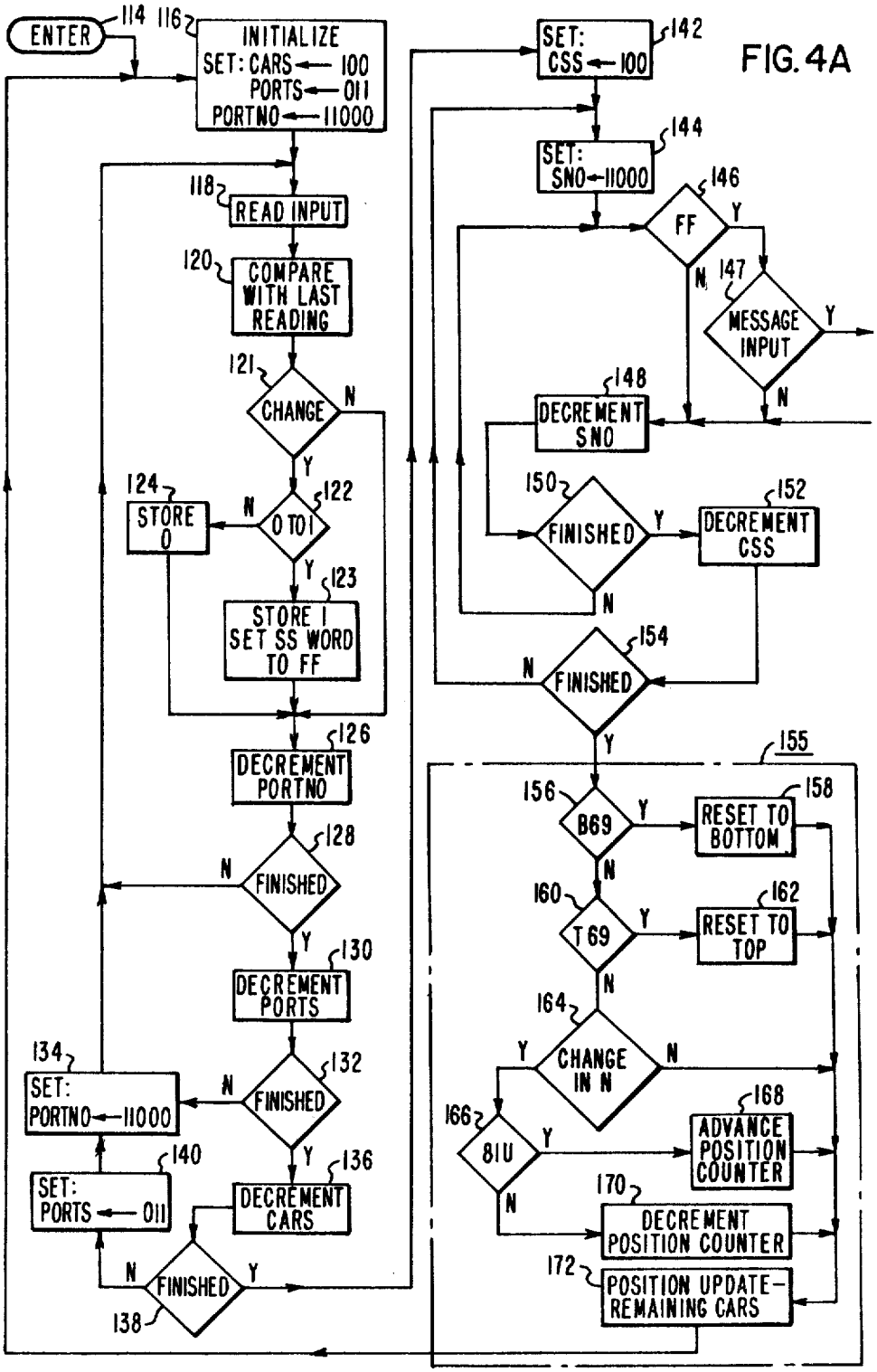
FIGS. 4A and 4B may be assembled to set forth an exemplary flow chart which may be used by the CPU shown in FIG. 1 in carrying out the teachings of the invention.
Figure 4B:
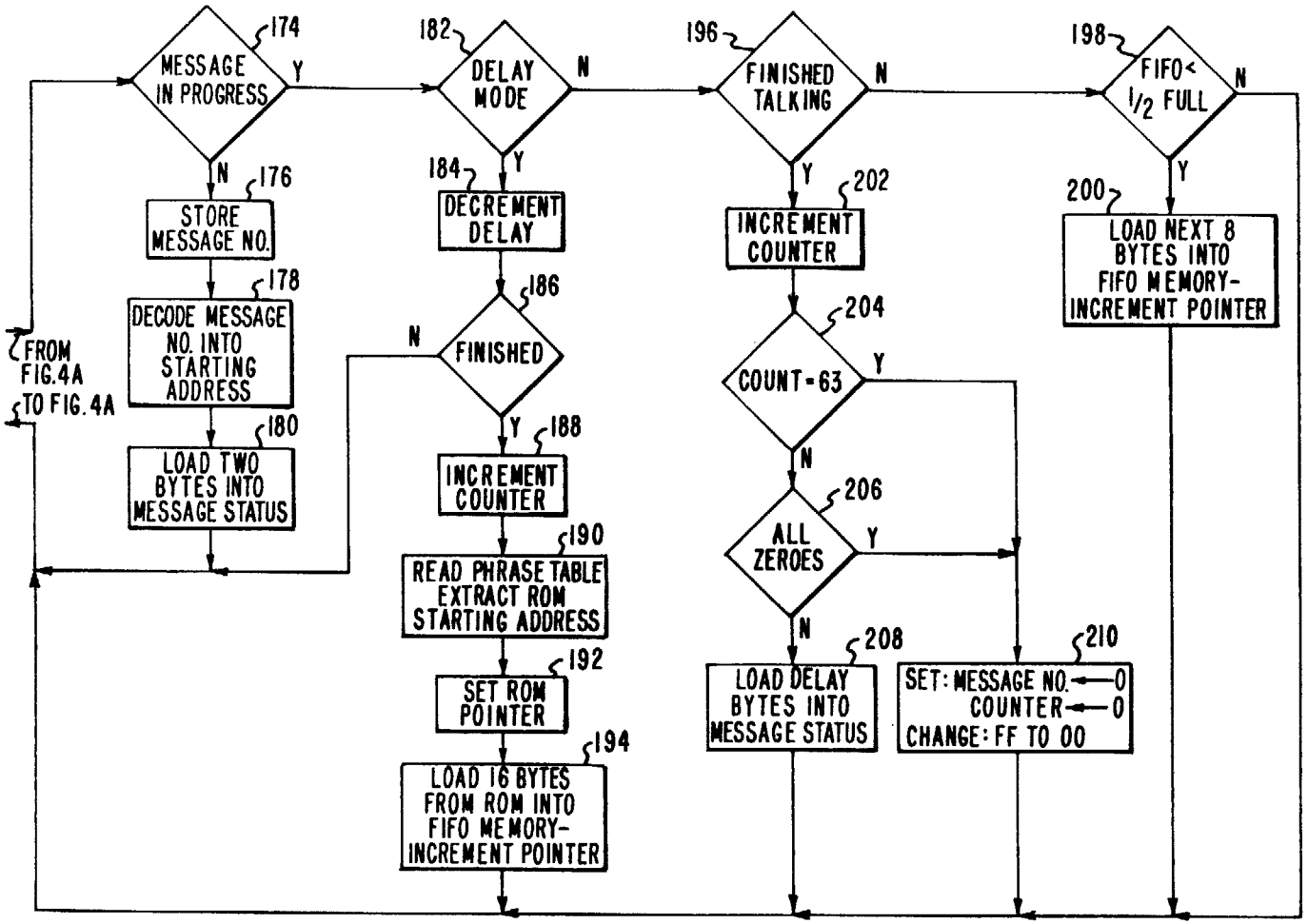

FIGS. 4A and 4B may be assembled to set forth a flow chart of an exemplary program which may be used by CPU 32 in implementing the teachings of the invention. The program is entered at 114 and the system is initialized at 116, such as by setting CARS to the number of cars in the system, such as four (100), by setting PORTS to the numbers of input ports per car, such as three (011), and by wetting PORTNO to the number of terminals per input port, such as 24 (11000). The inputs from all of the cars are then successively read, starting with step 118, which reads the first input terminal of the first port of the first car (car A). Step 120 compares the reading with the last reading stored in RAM location 108 of FIG. 2. Step 121 determines if the signal has changed since the last reading. If it has, step 122 determines the nature of the change. If it changed from a 0 to a 1, step 123 stores a 1 at the proper bit location in RAM 38, and it sets the corresponding signal status word at memory location 110 of RAM 38 to FF (all 1's). If the change was from a 1 to a 0, step 124 stores a 0 at the proper bit position of RAM memory location 108.

Step 126 decrements PORTNO and step 128 checks to see if all of the input port terminals have been checked. If not, the program returns to step 118. If all 24 of the inputs of the port being considered have been checked, step 130 decrements PORTS, in order to check the inputs of the next input port. Step 132 checks to see if all of the input ports of the car being considered have been checked. If not, step 134 sets PORTNO at 24 (11000) and the program returns to step 118. When step 132 finds that all of the input ports have been checked, step 136 decrements CARS and step 138 checks to see if the inputs from all of the cars have been checked. If not, step 140 sets PORTS to 3 (011), step 134 sets PORTNO to 24 (11000), and the program returns to step 118. When step 138 finds all of the input ports of all of the cars have been checked, the program advances to the next phrase of the program which checks the signal status of each car, memory location 110 of RAM 38.

More specifically, step 142 sets CSS to the number of cars, such as four (100), and step 144 sets SNO to the number of signal status words, i.e., 24 (11000). Step 146 checks to see if the first signal status word is all 1's (FF). If it is, step 147 checks to see if this is a message request input. If it is, the program advances to step 174. If step 146 finds that the signal status word is not FF, or step 147 finds it is not a message request input, step 148 decrements SNO and step 150 checks to see if all of the signal status words for the car being considered have been checked. If not, the program returns to step 146. If they have, step 152 decrements CSS and step 154 checks to see if all of the cars have been considered. If not, the program returns to step 144. If the signal status words of all of the cars have been checked, the program enters another phase, shown within broken outline 155, which updates the floor positions of the cars. Phase 155 is not required if the floor positions are given to CPU 32 from the cars. If the floor positions are not given to the CPU, the CPU can follow the cars via certain of the signals provided from the cars.

More specifically, step 155 checks to see if input signal B69 is true, indicating the car is located at the lowest floor. If so, the floor position counter, location 112 in RAM 38, is set to the lowest floor in step 158, and the program advances to step 172 to update the positions of the other cars. If signal B69 is not true, step 160 checks signal T69 to see if the car is located at the uppermost floor. If it is, step 162 sets the position counter to the count of the highest floor and the program advances to step 172. If the car is not located at either terminal, step 164 checks for a change in signal N, which changes logic level each time the car floor selector notches into another floor. If it has not changed since the last reading, the program advances to step 172. If it has changed, step 166 checks the car travel direction. Step 168 advances the floor position count if the car is traveling upwardly, and step 170 decrements the count when the car is traveling downwardly. Both steps 168 and 170 advance to step 172, to repeat the car position update steps for each of the remaining cars.

If step 146 found that a car signal status word was all 1's, and step 147 found that it relates to a message selection input, step 174 determines if this is the first detection of the message request by checking memory location 100 of RAM 38. If it is the first detection of the message request, location 100 will be 0's, and step 176 stores the message number at location 100 of RAM 38. CPU 32, in step 178, decodes the message number into the starting address for this message in the phrase table shown in FIG. 3, which is stored in ROM location 36. Step 180 loads the first two bytes of the phrase table found at the starting address for this message into location 104 of RAM 38. This is the delay value which determines the time length of the delay before the audio portion of the message begins. The program then returns to step 148.

If step 174 found that location 100 of RAM 38 was not 0's, indicating a message in progress, step 182 checks the second bit of the phrase table counter found at location 102 of RAM 38 to see if the message is in a delay mode. This bit position will be a zero when the message is in the delay mode. If it is a zero, step 184 decrements the delay value found at location 104 of RAM 38, and step 186 checks to see if the delay time has expired. If it has not expired, the program returns to step 148. If the delay has been completed, step 188 increments the phrase table counter at location 102 of RAM 38 to point to the address instruction for phrase 1 of the message. Step 190 extracts the starting ROM address for the first phrase of the message, and step 192 loads this address into location 106 of RAM 38 to form the pointer for ROM 34, which stores the digitized vocabulary or voice patterns. Step 194 then selects the proper car, such as car A, and it requests the "write" operation for its speech processor 50, as described relative to FIGS. 1 and 1A. Then, as fast as the speech processor 50 can take the information, CPU 32 loads the first 16 bytes of the vocabulary information from RAM 34 into the FIFO memory of the speech processor 50, incrementing the ROM pointer at memory location 106 with each byte. When it has completed this process, the program returns to step 148.

If step 182 finds that the second bit position of the count at memory location 102 is a 1, the message is not in the delay mode, but in a phrase mode, and step 196 determines if the speech processor 50 has completed the phrase by reading an appropriate bit in the speech processor. A code in the vocabulary information indicates to the speech processor when the phrase has been completed, and the speech processor sets a "finish talking" bit when this code is detected. If step 196 finds that the phrase has not been completed, step 198 reads the speech processor to determine if the FIFO memory is less than one-half full. If it is not, the program returns to step 148. If it is less than one-half full, step 200 loads the next eight bytes of vocabulary information from ROM 34 into the FIFO memory, starting with the address pointed to by the ROM pointer at memory location 106 of RAM 38, incrementing the ROM pointer with each byte. The program then returns to step 148.

If step 196 finds that the speech processor 50 has finished the phrase, step 202 increments the phrase table pointer (counter) at memory location 102 by two. Step 204 checks to see if the count at location 102 has reached 63 (111111), indicating all 64 bytes of the messages have been processed, and thus the message completed. If the count has not reached 63, step 206 determines if the next two bytes are all 0's, which also indicates completion of the message. If the message has not been completed, step 208 loads the next two bytes from the phrase table, the delay value, into memory location 104 of RAM 38, and the program returns to step 148. If either step 204 or step 206 found the message to have been completed, step 210 sets the message number to 0's, at memory location 100, it sets the phrase table counter to 0's at memory location 102, and it changes the appropriate signal status word at memory location 110 from FF to 00.

In summary, a single CPU, operating with a single message center source and a single vocabulary source, can provide simultaneous voice announcements in a plurality of elevator cars. The same message can be simultaneously provided in all of the cars, if desired, because the use of a specific message by one car does not tie up this message. On the other hand, different messages may be simultaneously reproduced in the various cars. The floor speakers, if desired, may be delivering the same message as being delivered by an associated car speaker, or a floor speaker, or speakers, may be reproducing a different message than is being reproduced by an associated car speaker, as desired.

We claim as our invention:

1. An elevator system, comprising:

a building having a plurality of floors, at least two elevator cars mounted for movement in said building to serve floors therein, control means for each of said elevator cars for providing status signals indicative of the operation of its associated elevator car, and communication means for providing audible, informative messages in each of said elevator cars in response to at least certain of their status signals, said communication means including a first unit common to all of the elevator cars, with said first unit including a central processor unit, memory means having a first location for storing a predetermined vocabulary common to all messages, and a second location for storing a series of instructions for each message, said communication means further including a plurality of similar second units, one for each elevator car, with each second unit including sound reproduction means, and a speech synthesizer, with each speech synthesizer having memory means for storing information received from the memory means of the first unit, said central processor unit being responsive to the control means of each of said elevator cars and operating in response to the status signals provided thereby to address the instructions in the second location of said memory means, as required by a specific status signal, and using these instructions to extract vocabulary information from the first location of said memory means and store it in the memory means of the speech synthesizer associated with the elevator car to receive the audible message, said central processor unit providing and maintaining sufficient vocabulary information in the memory means of each speech synthesizer such that audible messages may be simultaneously produced by the sound reproduction means of all of said elevator cars, when required, without interruption due to lack of vocabulary information.

2. The elevator system of claim 1 wherein each of the second units of the communication means includes communication ports, with the control means for each elevator car providing its status signals at its associated ports, and wherein the central processor unit scans the ports to detect a status signal, with the status signals, ports, and scanning order being related such that the position of each status signal in the scan points the central processor unit to the start of the series of instructions for the related message in the second location of the memory means of the first unit.

3. The elevator system of claim 2 wherein the memory means of the first unit of the communication means includes a location for storing the status signals associated with each elevator car, with the central processor unit storing the results of each scan of the communication ports in said status signal location, and detecting the presence of a new status signal by noting a change from the last scan.

4. The elevator system of claim 3 wherein the memory means of the first unit of the communication means includes a location for storing status signal acknowledgement signals associated with each elevator car, with the central processor unit, upon noting a change in a status signal since the last scan, storing an appropriate signal in the status signal acknowledgement location of the memory means.

5. The elevator system of claim 4 wherein the central processor unit scans the location of the memory means where the status signal acknowledgement signals are stored to detect the next message to be processed for each elevator car.

6. The elevator system of claim 1 wherein the memory means of the speech synthesizer is a first in-first out (FIFO) memory, wherein the central processor unit initially fills the memory means of each speech synthesizer at the start of the message, and subsequently detects when the contents of the memory means has fallen below a predetermined level, whereupon the CPU loads a predetermined additional amount of vocabulary information from the first memory means into the speech synthesizer memory means.

7. The elevator system of claim 6 wherein the vocabulary information indicates the end of the phrase, with the speech synthesizer providing a "finished talking" signal for the CPU in response to processing this information, with the CPU proceeding to the next instruction in the second memory means in response to an indication from the speech synthesizer that it has finished talking.

8. The elevator system of claim 1 wherein the sound reproduction means for each elevator car includes a speaker mounted in the elevator car.

9. The elevator system of claim 1 wherein the building includes hatchways for each of the elevator cars, and openings to the hatchways from each floor of the building to be served by the elevator car, with said sound reproduction means for each elevator car including a speaker mounted in the elevator car and a speaker at each foor served by the elevator car, adjacent to the opening to the associated hatchway, with the speakers to be actuted being selected by the central processor unit in response to each specific message.

10. The elevator system of claim 1 wherein the certain instructions of the series of instructions for each message stored in the second location of the memory means of the first unit controls the delay time before the audible portion of the message starts.

* * * * *